US005114082A

United States Patent [19]

Brundiek

[11] Patent Number: 5,114,082

[45] Date of Patent: May 19, 1992

[54] GRINDING SURFACE OF ROLLING MILLS

[75] Inventor: Horst Brundiek, Kaarst, Fed. Rep. of Germany

[73] Assignee: Leosche GmbH, Dusseldorf, Fed. Rep. of Germany

[21] Appl. No.: 541,979

[22] Filed: Jun. 22, 1990

[30] Foreign Application Priority Data

Jun. 29, 1989 [DE] Fed. Rep. of Germany ..... 3921419

[51] Int. Cl.[5] ..... B02C 15/00

[52] U.S. Cl. ..... 241/121; 241/294; 241/300

[58] Field of Search ..... 241/117-121, 241/300, 295, 294

[56] References Cited

U.S. PATENT DOCUMENTS

| | | | |
|---|---|---|---|
| 1,480,767 | 1/1924 | Kreutzberg | 241/121 X |
| 2,228,480 | 1/1941 | Palmer . | |
| 4,074,737 | 2/1978 | Stewart | 241/294 X |
| 4,886,218 | 12/1989 | Bradley et al. | 241/300 X |
| 4,901,929 | 2/1990 | Barclay | 241/294 X |

FOREIGN PATENT DOCUMENTS

| | | | |
|---|---|---|---|
| 1507580 | 4/1969 | Fed. Rep. of Germany . | |
| 2354844 | 5/1975 | Fed. Rep. of Germany . | |
| 2643307 | 3/1978 | Fed. Rep. of Germany . | |
| 8708401.5 | 6/1987 | Fed. Rep. of Germany . | |
| 2043148 | 2/1971 | France . | |
| 240338 | 10/1986 | German Democratic Rep. | 241/300 |
| 3126563 | 5/1988 | Japan | 241/300 |
| 996768 | 6/1965 | United Kingdom . | |

*Primary Examiner*—Mark Rosenbaum
*Attorney, Agent, or Firm*—Fleit, Jacobson, Cohn, Price, Holman & Stern

[57] ABSTRACT

The invention relates to a grinding surface of rolling mills and specifically to the grinding surface of grinding rollers and a grinding path. As the hitherto known solutions have been considered inadequate for increasing the surface life of grinding surfaces, use is now made of ceramic segments as a wear-preventing cladding and they are also fixed against dynamic stressing forces on the body or basic shell.

12 Claims, 7 Drawing Sheets

GRINDING SURFACE OF ROLLING MILLS

Figure 1A:
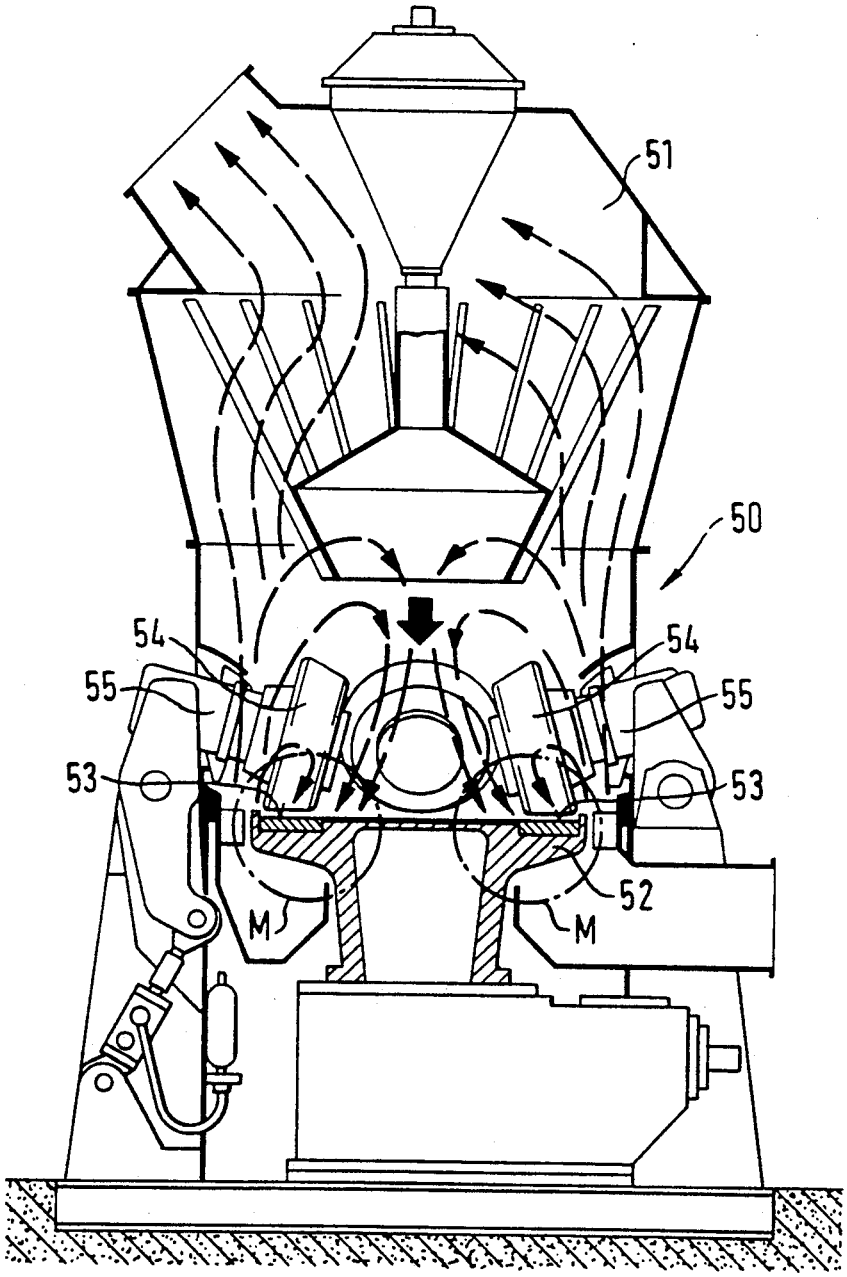

The invention relates to a grinding surface for rolling mills comprising grinding rollers and a grinding path, with fastening bodies for the grinding surface made from a ferrous or similar material, in which the grinding surface has a cladding applied segmentally to its fastening body and which is made from a much more wear-resistant material than the latter and the segments are positively fixed.

The above concept of the grinding surface of rolling mills is subsequently specifically understood to mean the facing surfaces of the grinding roller or rollers and the grinding path of the rotating grinding tray of a rolling mill. Between these facing grinding surfaces is provided the corresponding grinding clearance for comminuting materials such as cement raw material, cement clinker, coal or the like.

A grinding surface of the aforementioned type is known from DE 26 43 307 A1. In the latter the grinding surface relates to a grinding roller, which has over its circumference segmentally applied cladding elements made from a more wear resistant material than the roller shell. These cladding elements are positively inserted in dovetailed grooves in the roller shell and secured on the axial faces with flanged rings. Thus, in the case of this grinding surface the more wear-resistant cladding elements alternate with the softer roller shell material. These material differences ultimately lead in the case of such a grinding surface design to locally greater wear even on the harder metallic materials or the softer material on the grinding surface is abraded to a greater extent, so that loosening and even complete dropping out of the positively held cladding elements can take place.

Using even harder alloys of ferrous materials for the grinding surfaces only leads to a slight improvement to the service life of roughly 10 to 20%. There are also limits to the overdimensioning of grinding rollers or the grinding path, because it has been found that the regulatability of overdimensioned rolling mills decreases towards the partial load area, so that once again this solution is considered to be uneconomic with respect to the problem of wear.

It is admittedly known that ceramic materials have much better abrasion characteristics than ferrous materials (German utility model 87 08 401.5), so that said materials have been used for many years for the lining of static components, such as chutes, cyclones, etc. However, significant problems occur when ceramic materials are used for components, which are mainly exposed to dynamic loading.

Whilst ceramic components virtually have no thermal expansion, the metallic components, such as the bodies or roller shell of a grinding roller have relatively high thermal expansion coefficients, so that jointing problems occur with such a combination of ceramic components and metallic components. In addition, ceramic components are extremely liable to brittle fracture, so that punctiform loads, bending and torsional stresses must be avoided in connection therewith. In addition, these components are not designed for impact loading.

On the basis of these disadvantages the object of the invention is to so construct a grinding surface of the aforementioned type that it is possible to achieve a longer service life for the same, whilst also bringing about simplifications from the maintenance standpoint.

According to the invention this object is achieved in the case of the aforementioned grinding surface by the features that the segments are made from a ceramic compound, that the outer face of the segments forms in full-surface manner the grinding surface, that for the positive fixing of the segments against dynamic stressing forces at least in the radial direction of the grinding path surface of the rolling mill, the face of the fastening body of a grinding roller and a grinding plate facing the grinding surface has a step-like configuration in axial section and the shoulders of the step-like configuration support the segments of the cladding.

Thus, according to the invention, the grinding surface is formed from a segmentally constructed cladding, which is made from a much more wear resistant material, namely a ceramic material, than the fixing body to which the segments are fitted. This inventive concept is constructionally supplemented by a substantially positive support of the segments, so that the dynamic stressing forces, such as circumferential, thrust and shear forces are absorbed by corresponding positive design of the fixing body of the segments. In axial section, in order to bring this about the outer face of the fixing body is given a step-like contour, the individual steps forming in a grinding roller cylindrical surfaces with different diameters. In the case of a grinding roller, said step-like contour can be provided on the base shell, which is normally fixed to the roller body. However, it is also possible to directly fix the segments over the step-like contour to a roller body.

As a result of the step-like design of the body or the base shell of a grinding roller, the thrust forces acting axially on the segments can be absorbed via the shoulders of the individual steps.

With respect to the absorption of the tangential forces, i.e. forces in the circumferential direction of the grinding surface, splines are provided between the base shell and the segments, which prevent a displacement of the screwed-down, ceramic segments in the circumferential direction. The splines are normally constructed as metal wedges or parallelepipeds, which are e.g. screwed into corresponding grooves of the base shell and by roughly half their height extension project freely over the cylindrical bearing surface of the base shell and can form in said area a self-closure with recesses in the faces of the segments. The solines can be associated with the segments either individually or with a specific number of segments. In addition to or in place of the splines the tangential supporting of the segments can also be brought about by corner areas of polygonal ring faces. In this constructional solution of the absorption of the dynamic forces in the tangential direction, a divergence takes place from the circular shape of an individual cylindrical surface, e.g. the roller shell in radial section and the circular arc is replaced by a straight line with the length of the corresponding ceramic element in the circumferential direction. At the transition from one straight line into the other additionally a step or shoulder is provided against which is supported the corresponding ceramic segment for absorbing thrust forces in the tangential direction. The engaging faces of the ceramic segments in the vicinity of said step consequently have a different radial size, because the external grinding surface has a circular contour.

Considered in axial section, the longitudinal edges of the step in the body of the grinding roller are substantially axially parallel to the grinding roller axis. With respect to the grinding surface formed by the segments, these longitudinal edges preferably form an angle of inclination in the range of approximately 5° to 45° and preferably approximately 30°. The shoulders of the steps are at right angles to the longitudinal edges and are oriented in such a way that the axial forces can be absorbed.

For the static fixing of the ceramic segments to the base shell use is made of known screw, welding and/or adhesive couplings or joints. In the case of the grinding surface according to the invention, such an adhesive layer is appropriately used between the ceramic segments and the outer face of the steps for compensating unevenesses. However, as a result of the shoulders and splines provided, the screw fastenings used for static mounting purposes are free from shear, thrust and bending forces. The insertion openings for the screw fastenings of the segments are closed so as to be aligned with the remaining grinding surface following the static fixing of the segments, which can e.g. be brought about by inserting plugs. A suitable adhesive is used for filling any joining gaps left between the abutting surfaces of adjacent segments.

In order to avoid point loads between the segments of a grinding roller and the segments of a grinding path of a rolling mill, the spacing of the rocker from the grinding tray is mechanically so limited by means of stop screws or buffers, that there is always a minimum roller gap and no direct contact between grinding surfaces.

An identical concept of fastening the individual ceramic segments for the grinding surface of a grinding roller can be used for the grinding path of the grinding plate. A corresponding ferrous material grinding plate is for this purpose provided with a step-like surface in the radial direction. These annular, all-round steps then once again receive in sector-wise manner ceramic segments, which in this case can have a block-like radial section. On the grinding surface the segments can have step-like transitions of e.g. approximately 3 mm. However, preference is given to an aligned transition of the segments for a planar grinding surface.

As a result of the reduced abrasion of the ceramic segments for the corresponding grinding surfaces the rolling mill has a longer service life and consequently production stoppages are prevented. It is therefore possible to improve the service life by the segment fastening method as compared with conventional, hardened, metallic antiwear cladding, but also with respect to purely static fastenings of ceramic linings.

Advantages are also obtained with regards to maintenance measures on the wear-prone parts of the grinding rollers or grinding path, in that the ceramic grinding surface can be replaced in segmental manner, whereas in the case of metallic wear-prone shells and also shell segments, it is standard practice to use heavy lifting equipment. The construction of the grinding surfaces with ceramic segments consequently makes it more easy to manipulate the same compared with metal segments, which makes it possible to significantly reduce service costs.

Moreover, a segmental, ceramic grinding surface offers the possibility of making the roller shell from cheaper materials in place of more expensive, hardened metal materials. Thus, the basic structure remains fixed to the grinding roller base and is not in contact therewith even on replacing the grinding service. The annular segmental and/or sectorwise cladding of the grinding surfaces with ceramic material consequently leads to a cost reduction with respect to the wear-prone parts and the specific costs of e.g. DM/t/h can be roughly 40% of the costs hitherto involved.

Thus, according to the invention, the wear-prone segments are made from non-metallic materials and preferably from more wear-resistant ceramics, in conjunction with the metal body or base shell in such a way that in addition to the purely static holding function of the segments, it is also possible to absorb the dynamic forces occurring between the grinding roller and the grinding tray during the comminution process without impairing the static holding elements.

The invention is described in greater detail hereinafter relative to the drawings, wherein show:

FIG. 1*a* a front elevation through a rolling mill with the indication of the grinding surfaces.

Figures 1B, 2:
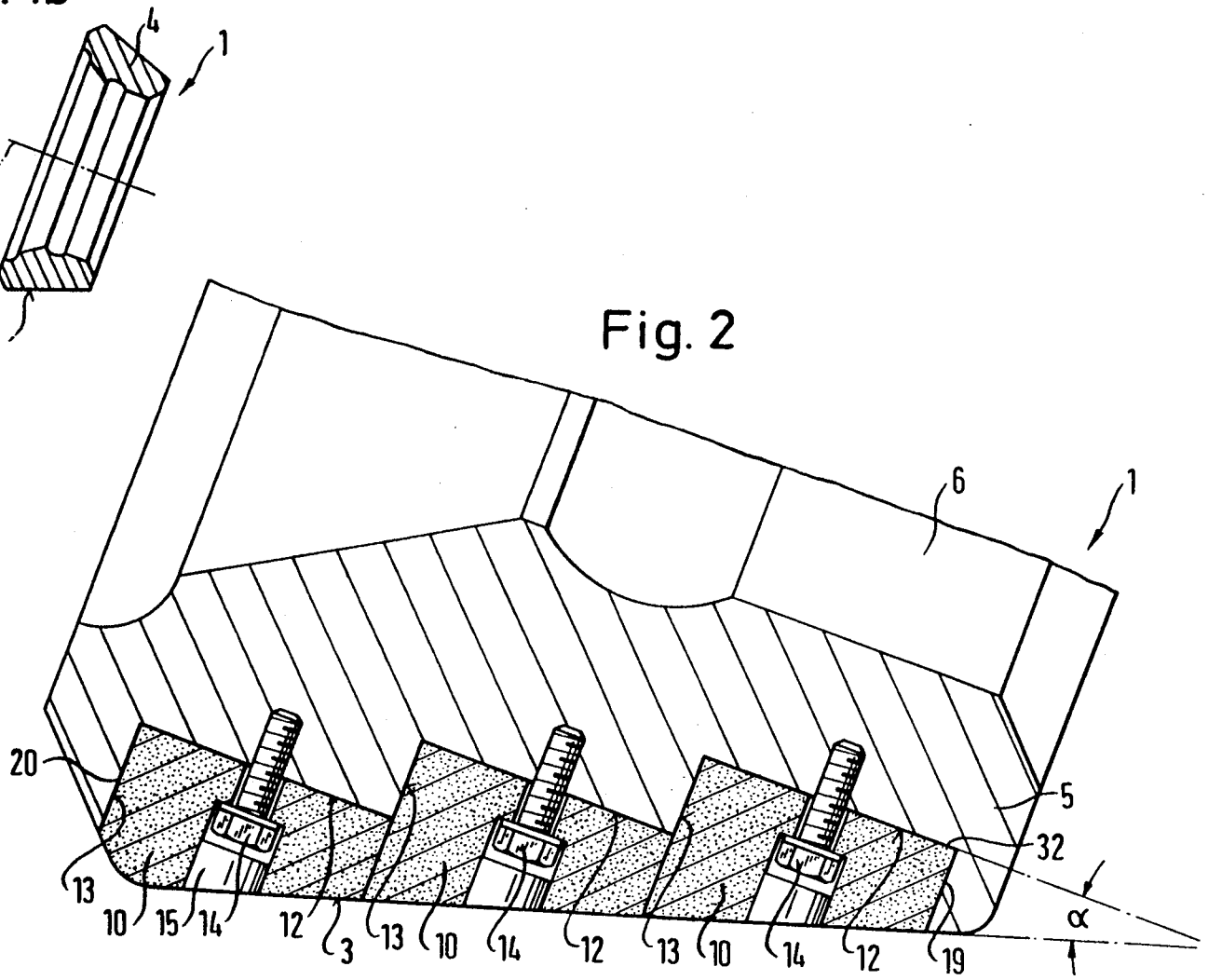

FIG. 1*b* an axial section through a grinding roller shell without a body and rocker.

FIG. 2 a larger-scale detail of the base shell in axial section with a corresponding grinding surface.

Figure 3:
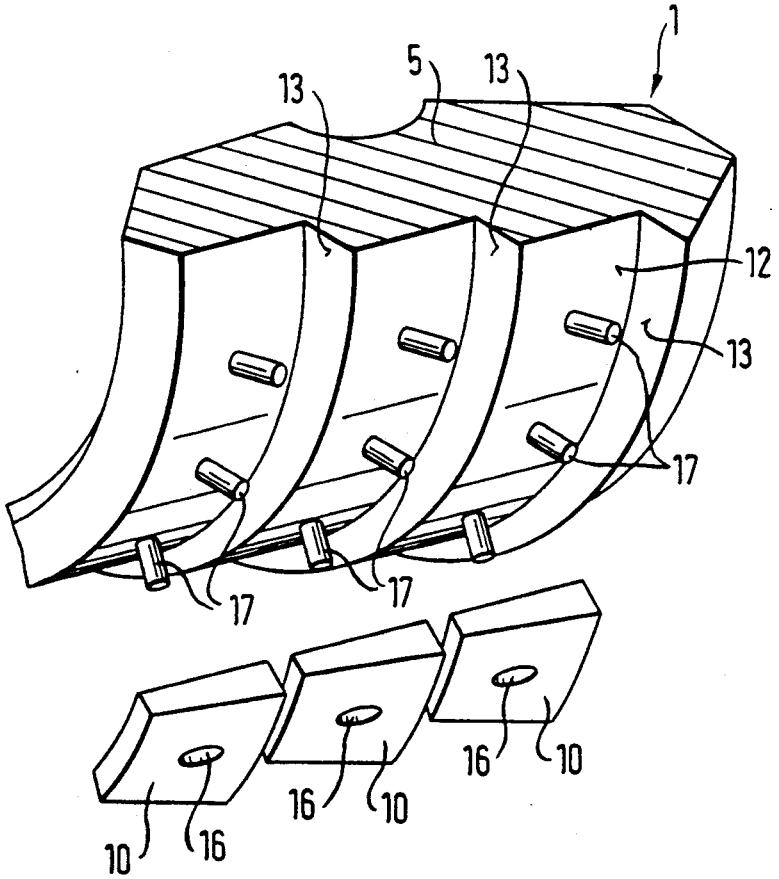

FIG. 3 a fragmentary, perspective exploded view of a grinding surface.

Figure 4A:
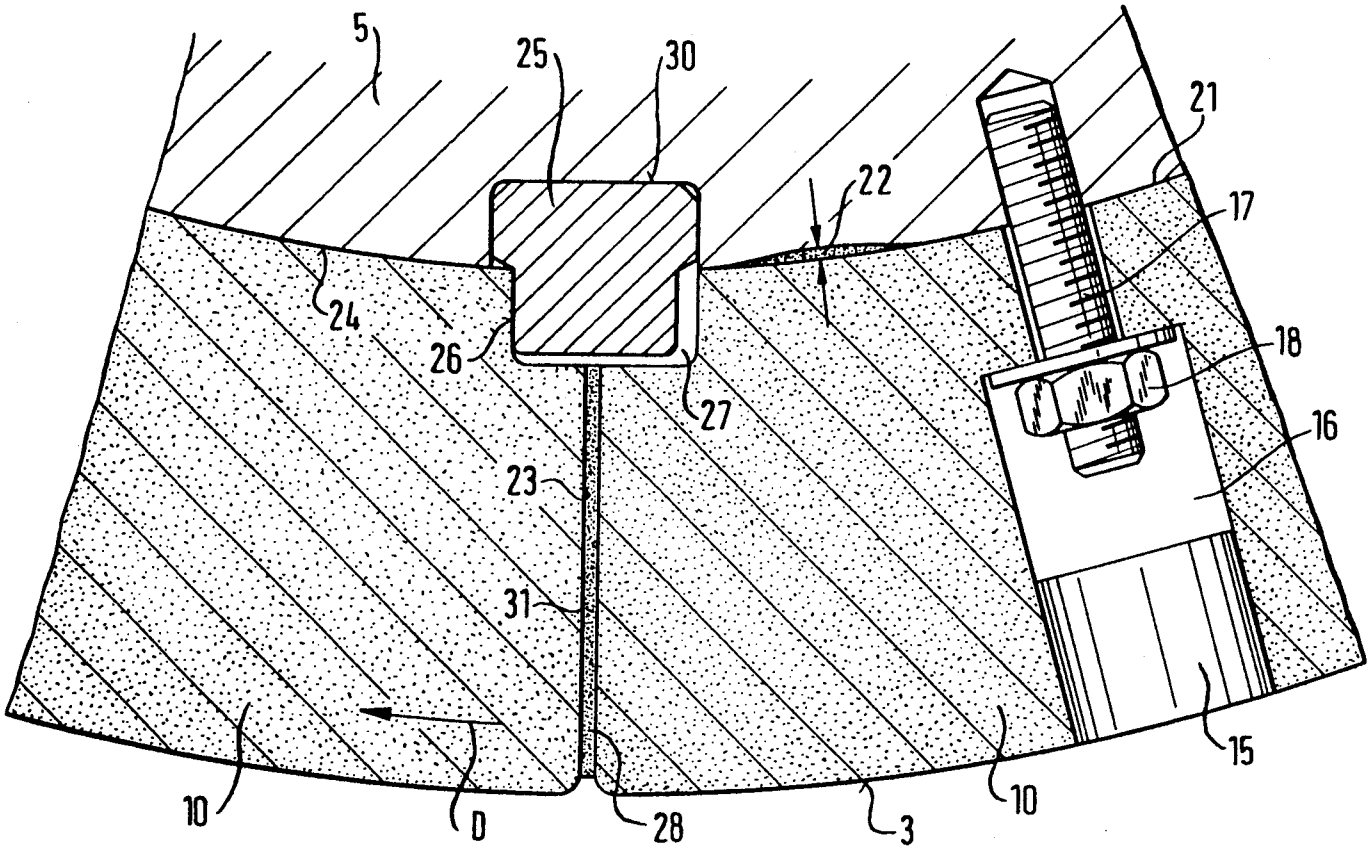

FIG. 4*a* a partial detail of a radial section through the embodiment of FIG. 2 in the vicinity of the butt joint of the segments with an approximately axially parallel spline.

Figure 4B:
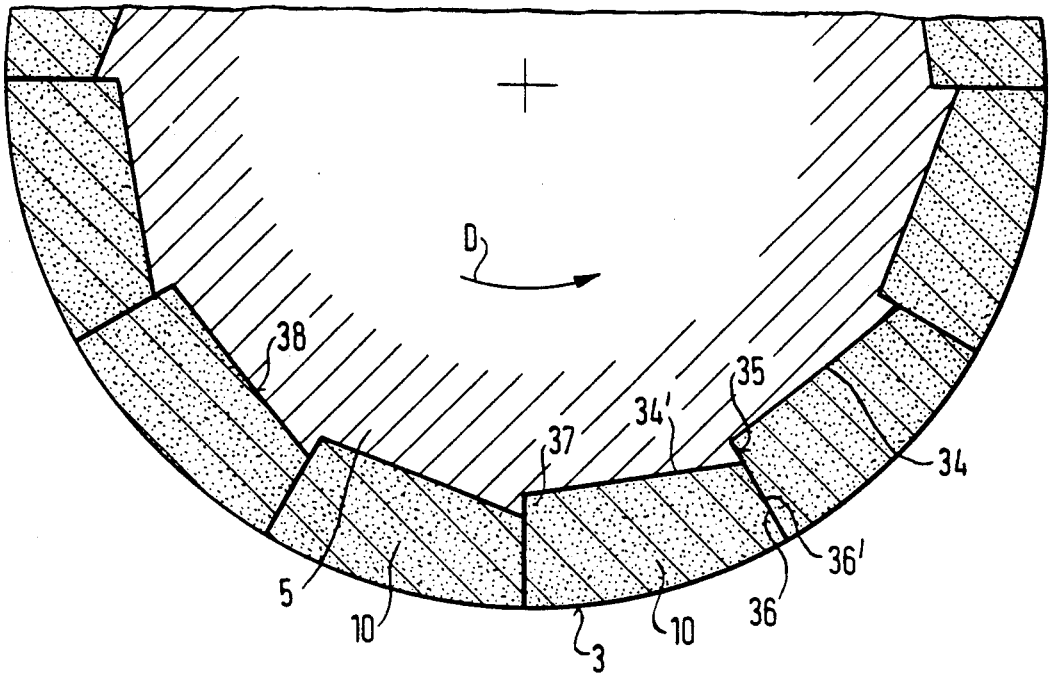

FIG. 4*b* a radial section corresponding to FIG. 4*a* with a polygonal ring face in place of splines.

Figure 4C:
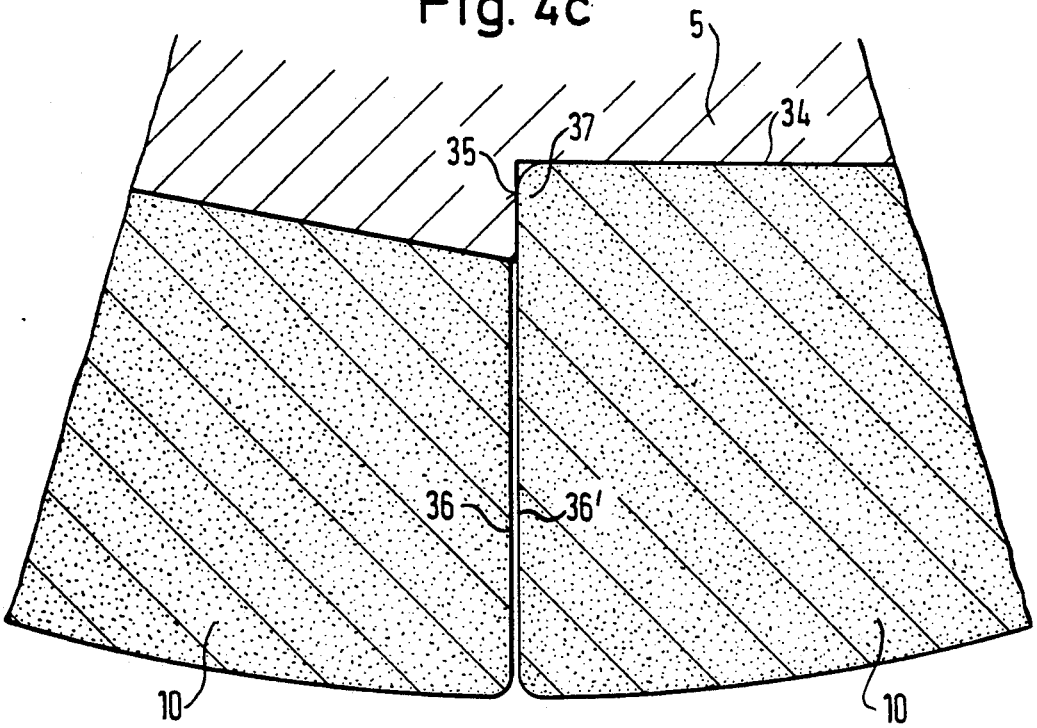

FIG. 4*c* an enlargement of the partial area of the polygonal ring face according to FIG. 4*b* in the vicinity of the step.

Figure 5A:
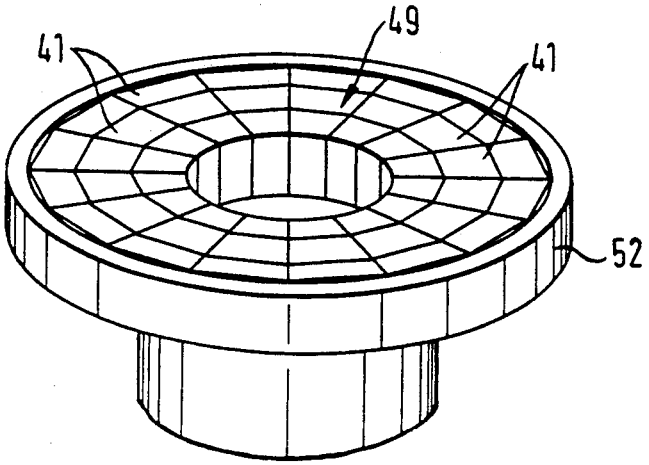

FIG. 5*a* a perspective view of a grinding tray with a grinding plate, whose grinding surface has ceramic segments.

Figure 5B:
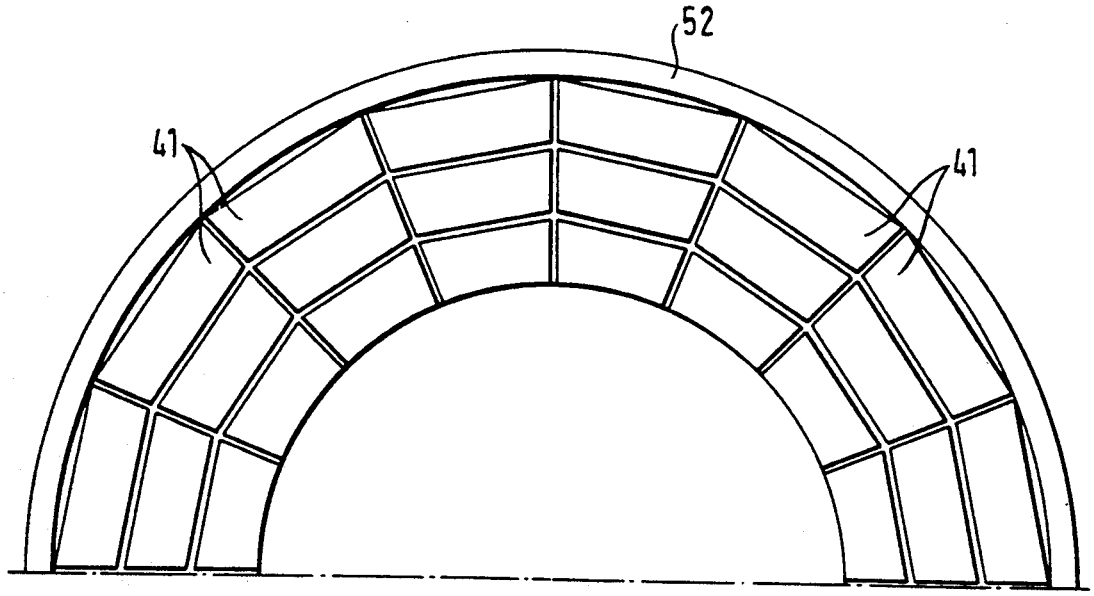

FIG. 5*b* a plan view of the grinding tray according to FIG. 5*a* with a partial representation of the arrangement of the ceramic segments.

Figure 5C:
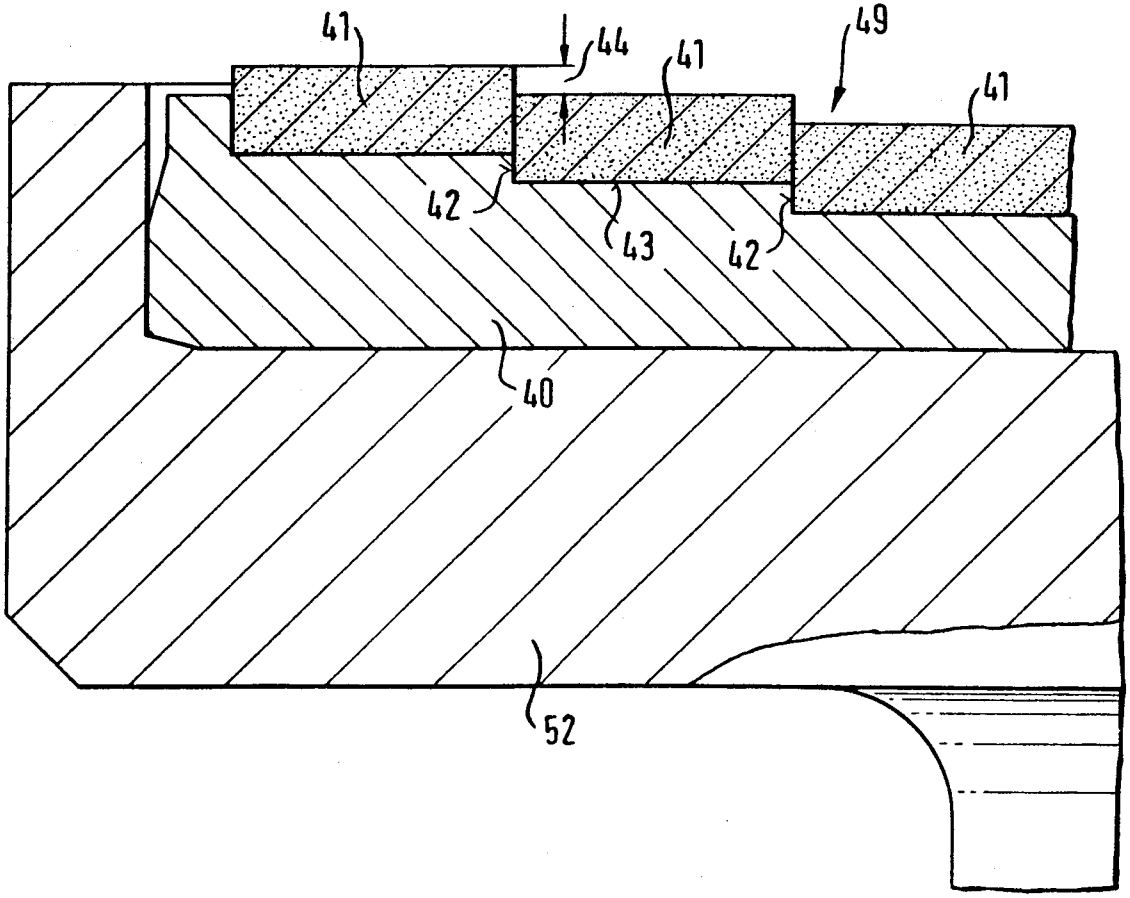

FIG. 5*c* a fragmentary radial section through the grinding surface of the grinding tray according to FIG. 5*a*.

FIG. 1*a* diagrammatically shows in front elevation a roll mill 50, which has a mounted, integrated sifter 51. Above the grinding tray 52 and its grinding path 53 are provided grinding rollers 54, which can be resiliently pressed against the grinding material on the grinding path by means of rockers 55. The grinding tray 52 is normally rotated by means of a gear. The broken flow lines show the flow conditions of the air/dust mixture in the rolling mill and the integrated sifter.

The area M decisive with a view to the design of the grinding surfaces according to the invention and in which further embodiments are considered in detail is represented by a circle.

FIG. 1*b* is an axial section through a grinding roller 1. The roller shell 4 is so arranged on the not shown body that the grinding surface 3 is approximately parallel to the corresponding grinding surface of a grinding tray. Normally the rockers for the grinding roller 1 would extend upwards towards axis 2.

The lower portion of the roller shell 4 is shown on a larger scale in FIG. 2. The normally ferrous material base shell 5 has several steps 12 in the direction of the grinding surface 3 and their transitions are constructed in the form of shoulders 13. Whilst the longitudinal edges 32 of the steps 12 are roughly axially parallel to the axis 2, the shoulders 13 are roughly at right angles to said axis.

Considered over the grinding roller circumference, the longitudinal edges 32 of the steps 12 form cylindrical surfaces, which are covered by ceramic material segments 10. The angle of inclination $\alpha$ between the approximately horizontal grinding surface 3 and the longitudinal edge 32, which can e.g. be between 5° and 45° leads to wedge-shaped segments 10.

With respect to their static holding or maintaining, the individual segments 10 are fixed by means of a screw 14 engaging in the base shell 5 through an opening on the side of the grinding surface roughly at right angles to the axis 2. For additional static fixing purposes, it is also possible to place an adhesive material between the base shell 5 and the inner face of the particular segment 10 and this additionally brings about a material compensation between unevenesses of the engaging surfaces.

As this static mounting of the ceramic segments 10 is not adequate for the dynamic loading of the grinding rollers, the left-hand sides of the segments engage at least partly and possibly up to approximately 80% of their extension against shoulders 13, so as to be able to absorb axially leftward directed forces. The adjacent three rows of segments 10 are bounded and fixed towards the outside by an outer shoulder 20 and towards the inside by an inner shoulder 19 of the base shell 5.

In the perspective, fragmentary view according to FIG. 3 pins 17 are shown on the annular, all-round steps 12. These pins engage in the opening 16 of the wedge-like segments 10. In such cases and as shown in FIG. 4*a*, the static holding takes place by means of a nut 18. The opening 16 can e.g. be sealed in surface-aligned manner with the grinding surface 3 by means of a plug 15.

The radial section through a roller shell according to FIG. 4*a* shows the design of the union between the segments and the base shell 5 for absorbing forces in the circumferential or rotation direction D. For this purpose the inner faces 24 of the segments 10 have in the vicinity of their abutting points 23 L-shaped or L-complementary recesses 27. A spline 25 having a substantially parallelepipedic cross-section fitted into a U-shaped groove 30 of the base shell 5 engages substantially positively into said recess 27 of adjacent segments 10. The spline 25 which is in the present case wider in the base shell 5 than in the segmental area consequently absorbs the tangential forces acting on the bearing surfaces 26 and consequently prevents a shear or thrust stressing of the pin 17. The normally steel splines 25 consequently block a movement of the ceramic segments 10 in one or other direction of the roller shell. The joining gap 31 at the abutting points 23 formed between adjacent segments 10 can e.g. be filled by a ceramic adhesive 28, which prevents direct contact between the segments 10 and brings about a compensation at the grinding surface.

The splines 25 can appropriately be provided at the abutment points of two adjacent segments 10. However, it is also possible to associate such a spline 25 with several segments 10 for absorbing the tangential forces thereon. An adhesive layer 22 optionally provided at the interface 21 between a segment and the base shell 5 can be used for compensating material unevenesses.

FIG. 4*b* shows a radical section through the cylindrical surface of a grinding roller comparable to FIG. 4*a*. However, in the embodiment according to FIG. 4*b* the tangential forces acting on the ceramic segments 10 are absorbed by means of an alternative construction. The circular cylindrical surface of the individual steps 12 according to FIG. 3 are, in the embodiment according to FIG. 4*b*, formed by a polygon of individual lines 34 and at the transition from the latter to the following lines 34' a step 35 is formed. As the radial height 36' of the ceramic element 10 is kept larger than its radial height 36, the radially inner area 37 of the particular ceramic segment 10 is circumferentially supported against the step 35, which can be worked directly into the member 5. By means of such a polygonal ring surface the splines according to FIG. 4*a* can be replaced in a simple and advantageous manner.

The ring union of the ceramic segments 10 is consequently secured by the double support with respect to dynamic stresses in the axial and tangential directions in an automatic manner and also against rotation with respect to the metallic basic shell. Such a rotation of individual segments was possible hitherto, because in the case of the pairing of the roller shell end the grinding tray no pure rolling movement occurred over the entire shell width, unless by chance the rotation axes of the roller shell and the grinding tray coincided at one point of the grinding path plane. The cooperation of splines 25 and shoulders 13 or the design as a polygonal ring surface 38 makes it possible to design the cladding of the grinding surface with ceramic segments 10, which leads to important advantages compared with the known roller shells.

FIGS. 5*a* to 5*c* diagrammatically show in greater detail the further grinding surface 49, which is now associated with the grinding tray 52. The perspective view according to FIG. 5*a* firstly shows a "spiders web-like" arrangement of the individual segments 41 on the grinding plate 40. In plan view and as shown in FIG. 5*b*, the segments 41 of the grinding surface 49 have a trapezoidal contour, the outer segments having larger polygon lines.

In accordance with the axial section according to FIG. 5*c* the grinding tray 52 receives a metallic grinding plate 40 in the sense of an insert. The surface of the grinding plate 40 is designed with step-like portions 43. Thus, the steps 43 pass via shoulders 42 into the adjacent step. Ceramic segments 41 are positively fixed to said steps 43. This fixing appropriately takes place in the same way as the fixing of the segments 10 to the basic shell 5. In the embodiment according to FIG. 5*c*, the segments 41 have a rectangular contour and engage positively against the shoulders 42 or the longitudinal edges of the steps 43. In the radial direction of the grinding tray, with minor projecting lengths 44 of e.g. 1 to 3 mm, the segments 41 pass into the next segment 41. The grinding path surface 49 correspondingly has a step-like contour. As a function of needs it is also possible to build up planar grinding path faces with a continuous grinding surface transition between the individual segments.

The design of the grinding surface 3 of the grinding rollers, as well as the grinding surface 49 of the grinding tray with ceramic segments, consequently offers an excellent wear protection. In addition, as a result of the segmentation and the lighter weight, maintenance measures can be performed much less expensively.

I claim:

1. Rolling mill comprising grinding rollers and a grinding path each having a fastening body of ferrous material for attaching a grinding surface including a cladding of wear-resistant segments made from a ceramic compound and tightly fixed to said fastening bodies, the segments having outer faces which form the entire grinding surfaces, and in which said fastening bodies of said grinding rollers and said grinding path facing the grinding rollers have a step-like configuration in axial section which support the segments of the cladding for positively fixing said segments against dynamic stressing forces in the radial direction of the grinding surfaces of the rolling mill.

2. Rolling mill according to claim 1, in which the segments have sides which engage at least partly and up to 80% of their extension against shoulders of said step-like configuration.

3. Rolling mill according to claim 1, in which a longitudinal edge of each step of the step-like configuration of said roller fastening body forms an angle of inclination in the range of 5° to 45° with respect to the grinding surface.

4. Rolling mill according to claim 1, in which at joints the segments positively engage in corner areas of polygonal ring surfaces of said fastening body for securing against dynamic tangential forces.

5. Rolling mill according to claim 1, in which segments are secured against dynamic tangential forces by splines along segment joints, which positively engage in said fastening body.

6. Rolling mill according to claim 5, in which said splines are fixed in said fastening body and positively engage in recesses of said segments.

7. Rolling mill according to claim 1, in which the fastening body of said grinding roller is a base shell of the roller.

8. Rolling mill according to claim 1, in which an inner face of segments are each laterally fixed by means of a single screw to each step-like configuration of said fastening body.

9. Rolling mill according to claim 8, in which openings for screw couplings in the segments are enclosed in an aligned manner with the grinding surface.

10. Rolling mill according to claim 1, in which an inner face of said segments is laterally fixed only by means of adhesive joints to said fastening body.

11. Rolling mill according to claim 1, in which the segments and the fastening bodies of the grinding rollers and the grinding path facing the grinding rollers form several polygonal ring bodies which in an axial section produce adjacent cylindrical rings of different diameters.

12. Rolling mill according to claim 1, in which joints between the segments are filled with ceramic adhesive.

* * * * *